United States Patent [19]

Sayles

[11] 3,972,967

[45] Aug. 3, 1976

[54] ACCELERATED CURING METHOD FOR SOLID PROPELLANTS

[75] Inventor: David C. Sayles, Huntsville, Ala.

[73] Assignee: The United States of America as represented by the Secretary of the Army, Washington, D.C.

[22] Filed: Nov. 29, 1973

[21] Appl. No.: 418,319

[52] U.S. Cl. ..... 264/3 R; 149/76; 149/19.3; 149/19.91; 149/19.92

[51] Int. Cl.$^2$ ..... C06B 21/00

[58] Field of Search ..... 164/3 R; 149/76, 19.3, 149/19.91, 19.92

[56] References Cited

UNITED STATES PATENTS 3,070,470 12/1962 Argabright et al. ..... 264/3 R

*Primary Examiner*—Stephen J. Lechert, Jr.
*Attorney, Agent, or Firm*—William G. Gapcynski; Lawrence A. Neureither; Jack W. Voigt

[57] ABSTRACT

A method is disclosed for curing a nitrogen-fluorine propellant in an electromagnetic alternating field. The propellant is cast into thin walled-titanium tubes of predetermined size and with a graphite-epoxy overwrap. When the propellant-filled tubes are exposed to electromagnetic radiation, the propellant is cured to a grain in about 30 minutes as compared to about 5 days required for thermal curing at 135°F. The disclosed method of curing is achieved because of the permeability of the overwrapped tubes to microwaves. The grain cured by the disclosed method acquires the desired mechanical properties, particulary, a greater uniformity, as indicated by a higher Shore hardness value, within a considerably shorter time period. The greater uniformity of mechanical properties throughout the propellant grain is particularly essential for this application because of the small quantity of propellant and the thrust repeatability necessary from one micromotor to another in the Maneuver Motor Array. Accelerated rate of cure is particularly advantageous because of the shortened turn-around time for the motor casting equipment. This is particularly desired because of the large number of motor tubes which must be cast for each array (112 tubes per array).

4 Claims, No Drawings

ACCELERATED CURING METHOD FOR SOLID PROPELLANTS

BACKGROUND OF THE INVENTION

Solid propellant is generally cured by exposing the cast, molded, or extruded propellant to elevated temperatures (135°F) for a period of time up to about 5 days or longer. Because of the extended time required to cure by conventional procedure, the tie-up of the casting tooling and the long turn-around time means excessive delays which results in increased production costs. Also, the extended curing time allows some settling of ingredient to take place which causes a gradation of mechanical properties throughout the cured propellant grain.

Desirable would be a method for curing propellants which would reduce the time for curing and ultimately reduce casting tooling requirements and turn-around time.

Also, desirable would be a method for curing propellant which results in a propellant with improved mechanical properties as compared with propellant cured by conventional thermal curing methods.

Therefore, an object of this invention is to provide a method for decreasing the curing time of nitrogen-fluorine propellant.

Another object of this invention is to provide a method for curing nitrogen-fluorine propellant within a rocket tube to achieve improved mechanical properties and uniformity of mechanical properties in the cured propellant.

A further object of this invention is to provide a method for curing nitrogen-fluorine propellant in propellant tubes that are used in micro-motors which utilize thin walled-titanium tubes with a graphite-epoxy overwrap for containing the nitrogen-fluorine solid propellant.

SUMMARY OF THE INVENTION

A nonaluminized, difluoramino-plasticized propellant composition is exposed to continuous microwave curing while being contained in propellant tubes of the type used in micromotors. Curing time is reduced from about 5 days to about 30 minutes. The method for curing is accomplished after the propellant is cast into a thin walled-titanium tube of predetermined size that is overwrapped with a graphite reinforced resin. The tubes employed in the preferred embodiment of this invention have outside and inside diameters of about 0.412 and 0.361 inch, lengths of about 9.65 inches, and wall thicknesses of about 0.026 inch. The described tubes are the preferred size for the micromotor employed in the HIT/Maneuver Motor Array; however, the thin walled-titanium tubes may vary in size and wall thicknesses. In any event, the tube should have sufficient wall thickness for use as a rocket motor tube since the propellant is cured in the tube which becomes part of the rocket motor when assembled later. The curing of the propellant in the tube is achieved since the tube is permeable to microwaves having a frequency in the range from 30 to 300,000 MHz. The microwave energy and curing time are variables which relate to propellant tube size and propellant composition for achieving the desired cure.

The microwave curing is particularly attractive for use in the HIT/Maneuver Motor Array which employs 56 micromotors with two propellant tubes per motor which has a T-configuration. Each of the tubes are precision made to an outside diameter of about 0.412 inch and an inside diameter of about 0.361 inch, length of about 9.65 inches, and a wall thickness of about 0.026 inch. Thus, the shortened cure time made possible by the accelerated curing method of this invention prevents the tie-up of the casting tooling, and the turn-around time is drastically reduced. The shortened cure time eliminates the settling of the solid ingredients which results in more uniform characteristics throughout the propellant grains. The unexpected results is uniformity of desired mechanical properties throughout the propellant which is verified by the results of Shore hardness tests values of 30 to 35 which is also indicative of completeness of cure.

The microwave-cure method is not applicable to all rocket motors because steel motor cases interfere with the penetration of the microwaves. Curing of very large propellant tubes would not be advantageous as the curing of small propellant tubes due to the quantity and related saving in turn-around time.

The representative propellant which is cured by the microwave-cure method is comprised of a copolymer of ethyl acrylate and acrylic acid, plasticized with tris[1,2,3-bis(1,2-difluoroamino)ethoxy]propane (TVOPA), cured with a multifunctional epoxide, 4,5-epoxycyclohexylmethyl-4′,5′-epoxycyclohexyl carboxylate (UNOX 221), and oxidized with ammonium perchlorate. Carbon black is added to eliminate combustion instability. The carbon black offers another advantage in that it promotes the microwave curing.

The plasticizer TVOPA has been employed in other experimental propellant formulations. It is one of several energetic difluoramino compounds which evolved from research and development work in high energy compounds. TVOPA is prepared by reacting tris(-vinoxy)propane (prepared in accordance with U.S. Pat. No. 2,969,400) with tetrafluorohydrazine. TVOPA contains two high energy difluoramino groups, $NF_2$, in each of the three vinoxy groups of the starting compound, tris(vinoxy)propane. The reaction of tetrafluorohydrazine with tris(vinoxy)propane to form TVOPA is conducted under pressure in the range of 500 mm of mercury up to about 600 psig and temperature ranges of about 0° to 120°C. The reaction is conducted in the presence of an inert volatile organic solvent, preferably one that is a suitable solvent for both the TVOPA as well as the reactant. Aromatic and aliphatic hydrocarbons, chlorinated hydrocarbons, ethers and ketones may be employed as the solvent. Typical solvents include diethyl ether, dipropyl ether, pentane, hexane, chloroform, carbon tetrachloride, methylene chloride, benzene, toluene, xylene, and acetone.

DESCRIPTION OF THE PREFERRED EMBODIMENT

The accelerated curing method for curing solid propellant in tubes that are utilized in micromotors comprises casting a difluoroamino-plasticized, electromagnetic energy-curable propellant composition in thin walled-titanium tubes with graphite-epoxy overwrap and thereafter subjecting the thin walled-titanium tubes containing the propellant composition for a predetermined period of about 30 to about 35 minutes to electromagnetic energy with a predetermined frequency range of 30 to 300,000 MHz to yield cured propellant grains in the tubes. The grains are characterized by a uniformity of measured Shore hardness from about 30 to about 35 throughout the propellant grains.

The grains cured by the method of this invention show greater uniformity as compared with grains cured by the conventional method.

A preferred difluoroamino-plasticized propellant composition for curing as described is comprised, as cast, of about 5.20 weight percent copolymer binder of polyethyl acrylate/acrylic acid (95/5), of about 29.47 weight percent plasticizer of tris[1,2,3bis(1,2-difluoramino)ethoxy]propane (TVOPA), of about 1.33 weight percent curing agent of 4,5-epoxycyclohexylmethyl-4′,5′-epoxycyclohexyl carboxylate (UNOX 221), of about 1.00 weight percent carbon black to enhance propellant's ability to absorb heat in an ultrahigh frequency field and to eliminate combustion instability in the cured propellant grain, and of about 63.00 weight percent oxidizer of ammonium perchlorate.

The curing described above is accomplished in a microwave oven or similar structure where microwaves, generated by a magnetron, are fed to the curing cavity through a waveguide or horn. As the microwaves enter the curing cavity, the microwave stream is reflected by rotating metal blades to insure that the stream is uniformly distributed throughout the curing cavity. The thin walled-titanium tubes with a graphite-epoxy overwrap are transparent to the electromagnetic energy which after entering the uncured propellant is converted into thermal energy which effects curing the propellant in a time period of about 30 to 35 minutes instead of about 5 days when curing is accomplished by present thermal (135°F) curing. Thus, the disclosed method provides desirable and unexpected benefits as disclosed hereinabove and as further illustrated in the table below where the characteristics of propellant by thermal cure and microwave cure are compared.

COMPARISON OF THE PROPERTIES OF HIT MICROMOTOR PROPELLANT UNDER DIFFERENT CURE METHODS

| Characteristics | Thermal Cure (135°F for 5 Days) | Microwave Cure (30 Min) |
|---|---|---|
| Tensile Properties | | |

-continued

COMPARISON OF THE PROPERTIES OF HIT MICROMOTOR PROPELLANT UNDER DIFFERENT CURE METHODS

| Characteristics | Thermal Cure (135°F for 5 Days) | Microwave Cure (30 Min) |
|---|---|---|
| Maximum Stress (psi) | 101 | 130 |
| Strain at Maximum Stress (%) | 26 | 38 |
| Modulus (Psi) | 590 | 780 |
| Burning Rate (ips at 1000 psi) | 1.8 | 1.8 |
| Shore Hardness | 31 | 35 |

I claim:

1. An accelerated curing method for curing solid propellant in propellant tubes for use in micromotors, said method comprising casting a difluoroamino-plasticized, electromagnetic energy curable propellant composition into thin wall-titanium tubes of predetermined size and with a graphite-epoxy overwrap; and thereafter, subjecting said thin walled-titanium tubes containing said propellant composition for a predetermined period of about 30 to about 35 minutes to electromagnetic energy with a predetermined frequency range of 30 to 30,000 MHz to effect curing of said propellant composition to yield cured grains in said tubes, said grains having a uniformity of measured Shore hardness from about 30 to about 35 throughout the propellant grains.

2. The accelerated curing method of claim 1 wherein said electromagnetic energy has the predetermined frequency of about 2450 MHz.

3. The accelerated curing method of claim 2 wherein said difluoroamino-plasticized, electromagnetic energy curable propellant composition as cast into said tubes is comprised of about 5.20 weight percent copolymer binder of polyethyl acrylate/acrylic acid (95/5), of about 29.47 weight percent plasticizer of tris[1,2,3-bis(1,2-difluoramino)ethoxy]propane, of about 1.33 weight percent curing agent of 4,5-epoxycyclohexylmethyl-4′,5′-epoxycyclohexyl carboxylate, of about 1.00 weight percent carbon black to enhance propellant's ability to absorb heat in an ultrahigh frequency field and to eliminate combustion instability in the cured propellant grain, and of about 63.00 weight percent oxidizer of ammonium perchlorate.

4. The accelerated curing method of claim 3 wherein said tubes have predetermined sizes that include outside and inside diameters of about 0.412 and 0.361 inch and wall thicknesses of about 0.026 inch.

* * * * *